US009936557B1

(12) United States Patent
Janik et al.

(10) Patent No.: US 9,936,557 B1
(45) Date of Patent: Apr. 3, 2018

(54) WHITE LIGHT TUNING

(71) Applicant: Cooper Technologies Company, Houston, TX (US)

(72) Inventors: Raymond George Janik, Fayetteville, GA (US); Russell Scott Trask, Sharpsburg, GA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 15/458,713

(22) Filed: Mar. 14, 2017

Related U.S. Application Data

(60) Provisional application No. 62/308,541, filed on Mar. 15, 2016.

(51) Int. Cl.
*H05B 33/08* (2006.01)

(52) U.S. Cl.
CPC ..... *H05B 33/0857* (2013.01); *H05B 33/0827* (2013.01)

(58) Field of Classification Search
CPC ..... H05B 33/0827; H05B 33/086; H05B 33/0857; H05B 33/0845; H05B 33/0863; F21Y 2103/10; F21Y 2115/10; F21K 9/56; F21K 9/64; H01L 25/0753; H01L 33/502
See application file for complete search history.

(56) References Cited

U.S. PATENT DOCUMENTS 8,783,887 B2 * 7/2014 Caruso ..... F21V 9/10 313/467
8,791,642 B2 * 7/2014 van de Ven ..... H05B 33/0824 315/192
9,500,327 B2 * 11/2016 Oepts ..... F21V 9/16
2016/0186968 A1 * 6/2016 Edwards ..... F21K 9/64 362/84
2017/0202071 A1 * 7/2017 Chen ..... H05B 33/0863

* cited by examiner

*Primary Examiner* — Haissa Philogene
(74) *Attorney, Agent, or Firm* — King & Spalding LLP

(57) ABSTRACT

A lighting device include a first string of light emitting diodes (LEDs) to emit a white light having a warm white Correlated Color Temperature (CCT) and a second string of LEDs. The second string of LEDs includes blue light LEDs that emit a blue light and green light LEDs that emit a green light. The lighting device further includes a tuning circuit to adjust an amount of current flowing through the second string of LEDs. The warm white light, the blue light and the green light produce a combined light, and a CCT of the combined light is tuned by adjusting the amount of current flowing through the second string of LEDs.

20 Claims, 6 Drawing Sheets

WHITE LIGHT TUNING

CROSS REFERENCE TO RELATED APPLICATIONS

The present application claims priority under 35 U.S.C. Section 119(e) to U.S. Provisional Patent Application No. 62/308,541, filed Mar. 15, 2016, and titled "White Light Tuning," the entire content of which is incorporated herein by reference.

TECHNICAL FIELD

The present disclosure relates generally to lighting solutions, and more particularly to white light tuning.

BACKGROUND

A typical lighting fixture may be designed to emit light that has a particular Correlated Color Temperature (CCT). For example, an LED light fixture may emit a warm white light (e.g. 2700-3000 K), a cool white light (e.g., 5000-6000 K) or a light with a CCT between warm and cool white lights. In some cases, a light fixture may be tuned to emit a light with a desired CCT. White color tuning may be performed to produce a light with a desired CCT. For example, white color tuning is commonly accomplished by using a combination of warm white light and cool white light, resulting in a combined light with a combined CCT that is a combination of the CCT of the warm white light and the CCT of the cool white light.

Sometimes, LEDs that emit a light with different particular color, such as Red, Green, Amber and Blue, are used with LEDs that emit warm white light and cool white light to move the combined CCT from one point of the black body curve to another. On a chromaticity chart, the combined CCT of the light resulting from such a combination of lights sits on a straight line joining a CCT of the warm white light and a CCT of the cool white light. In general, achieving a specific lumen output from such a combination requires twice the number of LEDs than needed to produce just a warm white light or just a cool white light. Further, the combined white light generally moves away from the black-body radiation curve as the combined CCT moves toward halfway between the warm and cool white lights. Achieving white light tuning cost effectively and reliably while keeping the CCT of the light relatively close to the black-body radiation curve can be challenging. Thus, a solution that enables white light tuning cost effectively and accurately to produce light that is relatively close to the black-body radiation curve is desirable.

BRIEF DESCRIPTION OF THE FIGURES

Reference will now be made to the accompanying drawings, which are not necessarily drawn to scale, and wherein.

Figure 1:
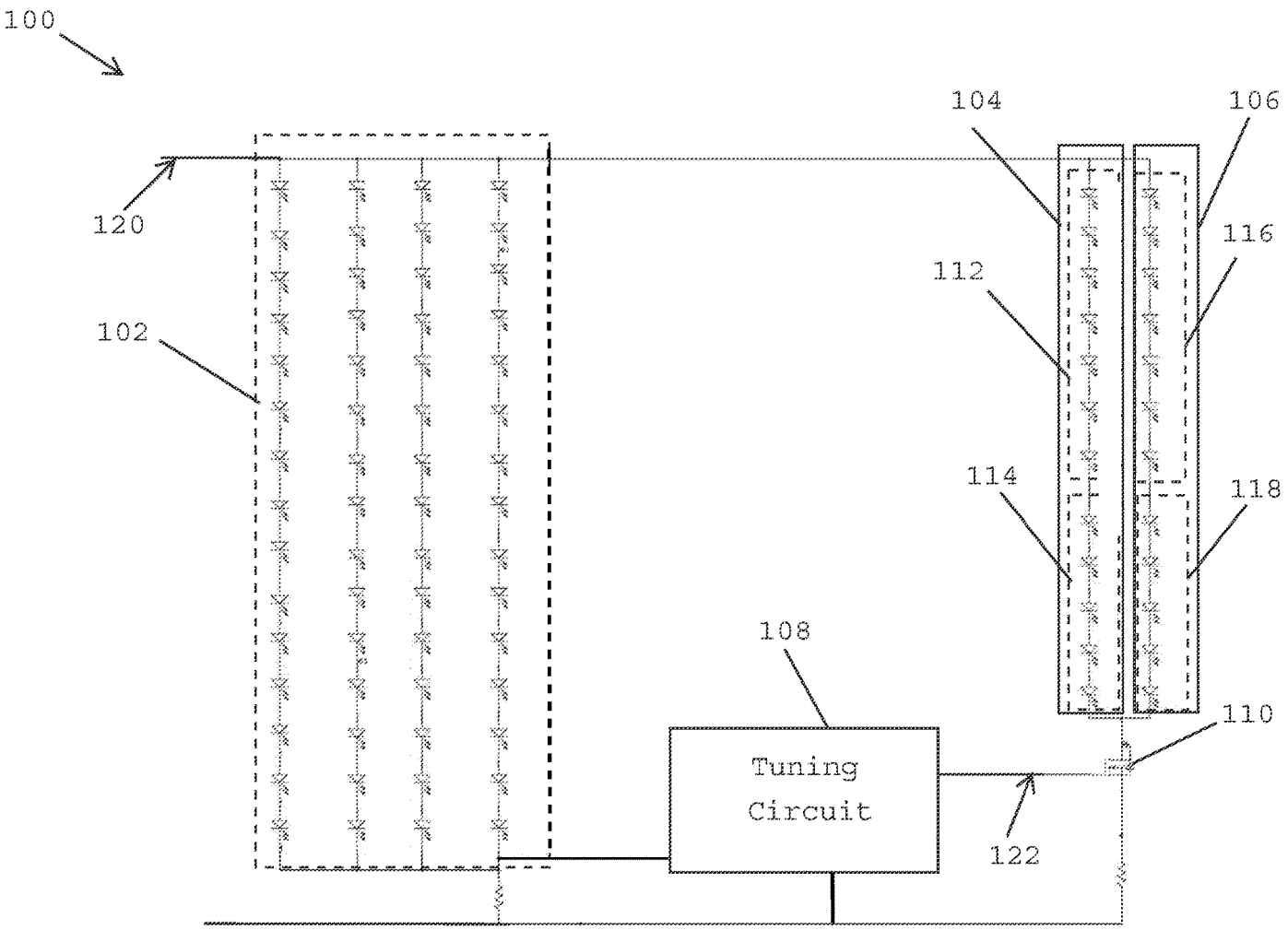
FIG. 1 illustrates a lighting device with a white light tuning circuit according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

SUMMARY

The present disclosure relates generally to lighting solutions, and more particularly to white light tuning. In an example embodiment, a lighting device includes a first string of light emitting diodes (LEDs) to emit a white light having a warm white Correlated Color Temperature (CCT) and a second string of LEDs. The second string of LEDs includes blue light LEDs that emit a blue light and green light LEDs that emit a green light. The lighting device further includes a tuning circuit to adjust an amount of current flowing through the second string of LEDs. The warm white light, the blue light and the green light produce a combined light, and a CCT of the combined light is tuned by adjusting the amount of current flowing through the second string of LEDs.

In another example embodiment, a lighting system includes a lighting device and a driver that provides power to the lighting device. The lighting device includes a first string of light emitting diodes (LEDs) to emit a white light having a warm white Correlated Color Temperature (CCT) and a second string of LEDs. The second string of LEDs includes blue light LEDs that emit a blue light and green light LEDs that emit a green light. The lighting device further includes a tuning circuit to adjust an amount of current flowing through the second string of LEDs. The warm white light, the blue light and the green light produce a combined light, and a CCT of the combined light is tuned by adjusting the amount of current flowing through the second string of LEDs.

In another example embodiment, a method of tuning a white light emitted by a light source includes providing a first string of LEDs that includes white light LEDs that emit a white light having a warm white Correlated Color Temperature (CCT). The method also includes providing a second string of LEDs that includes blue light LEDs and green light LEDs. The blue light LEDs emit a blue light, and the green light LEDs emit a green light. A required forward voltage across the second string of LEDs to emit the blue light and the green light is less than a required forward voltage across the first string of LEDs to emit the white light. The method also includes controlling, by a tuning circuit, an amount of current flowing through the second string of LEDs by adjusting an analog signal provided to a transistor that is in series with the second string of LEDs. The white light, the blue light and the green light produce a combined light, and a CCT of the combined light is tuned by adjusting the amount of current flowing through the second string of LEDs.

These and other aspects, objects, features, and embodiments will be apparent from the following description and the appended claims.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular example embodiments are described. FIG. 1 illustrates a lighting device 100 with white light tuning circuit 108 according to an example embodiment. In some example embodiments, the lighting device 100 includes strings of white light LEDs 102, strings of blue and green light LEDs 104, 106, and white light tuning circuit 108 that controls distribution of current between the strings of white light LEDs 102 and the strings of blue and green light LEDs 104, 106 by linearly controlling a transistor 110 (e.g., a MOSFET) that is in series with the strings of blue and green light LEDs 104, 106. The strings of white light LEDs 102 and the strings of blue and green light LEDs 104, 106 may be included in a light source of the lighting device 100. In some example embodiments, the LEDs of the strings of white light LEDs 102 and the strings of blue and green light LEDs 104, 106, may be discrete LEDs, organic light-emitting diodes (OLEDs), an LED chip on board that includes discrete LEDs, or an array of discrete LEDs. It may also include other colors, such as Cyan or phosphor converted colors, for the purpose of fine tuning or to improve color quality.

When a current is provided to the strings of white light LEDs 102, the strings of white light LEDs 102 emit a warm white light. For example, the strings of white LEDs 102 may emit a warm light having a warm white Correlated Color Temperature (CCT) of 2700K. As another example, the strings of white LEDs 102 may emit a warm light having a warm white CCT of 3000K. In some alternative embodiments, the strings of white LEDs 102 may emit a warm white light that has warm white CCT that is less than 2700K, more than 3000K, or between 2700K and 3000K without departing from the scope of this disclosure.

In some example embodiments, the strings of blue and green light LEDs 104, 106 may be in parallel with each other. As illustrated in FIG. 1, the combination of strings of blue and green light LEDs 104, 106, in series with the linear current control transistor 110 are in parallel with the strings of white LEDs 102. The string of blue and green light LEDs 104 includes a group of green light LEDs 112 that emit green light and a group of blue light LEDs 114 that emit blue light. The string of blue and green light LEDs 106 includes a group of green light LEDs 116 that emit green light and a group of blue light LEDs 118 that emit blue light. The groups of green light LEDs 112, 116 are each in series with a respective one of the groups of blue light LEDs 114, 118. To illustrate, the group of green light LEDs 112 is in series with the group of blue light LEDs 114, and the group of green light LEDs 116 is in series with the group of blue light LEDs 118.

The ratio of the flux of the blue light emitted by the group of blue light LEDs 114 to the flux of the green light emitted by the group of green light LEDs 112 is fixed. To illustrate, as the amount of the current that flows through both the group of blue light LEDs 114 and the group of green light LEDs 112 changes, the ratio of the fluxes (for example, in units of lumens) of the blue light and the green light remains reasonably unchanged. The ratio of the flux of the blue light emitted by the group of blue light LEDs 118 to the flux of the green light emitted by the group of green light LEDs 116 is similarly fixed.

The ratio of the flux of the green light to the flux of the blue light may be set based on a particular white light tuning path on the chromaticity chart between the warm CCT of the light emitted by the group of white light LEDs 102 and a particular cool white CCT. The cool white CCT may be, for example, 5000K or 5500K. To illustrate, a combined light resulting from the combination of the warm white light emitted by the group of white light LEDs 102, the blue light emitted by the groups of blue light LEDs 114, 118, and the green light emitted by the groups of green light LEDs 112, 116 may be adjusted/tuned along the particular white light tuning path between the warm CCT and the cool CCT.

As a non-limiting example, if the warm white light has a CCT of 2700K, a desired white light tuning path may be between the warm white CCT of 2700K and a desired cool white CCT of 5000K, and the ratio of the flux of the blue light and the flux of the green light may be selected to achieve such desired white light tuning path. The total flux of the blue and the green lights emitted by the strings of blue and green light LEDs 104, 106 may also be set such that the combined light (i.e., the combination of the warm white light emitted by the white light LEDs 102 and the blue lights and the green lights emitted by the strings of blue and green light LEDs 104, 106) may be tuned to have the desired cool white CCT by adjusting the total flux of the blue light and the green light. In some example embodiments, a particular white light tuning path may be selected relative to a black-body radiation curve to achieve a desired color quality. Other colors, such as yellow or amber, may be used in conjunction with green and blue to better tune the resultant color temperature.

In some example embodiments, a ratio of the flux of the green light to the flux of the blue light that results in a particular white light tuning path between the warm CCT and the cool white CCT may be achieved by selecting the appropriate numbers of green light LEDs in the groups of green light LEDs 112, 116 and the appropriate number of the blue light LEDs in the groups of blue light LEDs 114, 118.

In some example embodiments, the string of blue and green light LEDs 104 may include the same number of blue light LEDs and green light LEDs as the string of blue and green light LEDs 106. For example, the group of green light LEDs 112 may include the same number of green light LEDs as the group of green light LEDs 116, and the group of blue light LEDs 114 may include the same number of blue light LEDs as the group of blue light LEDs 118.

Figure 3:
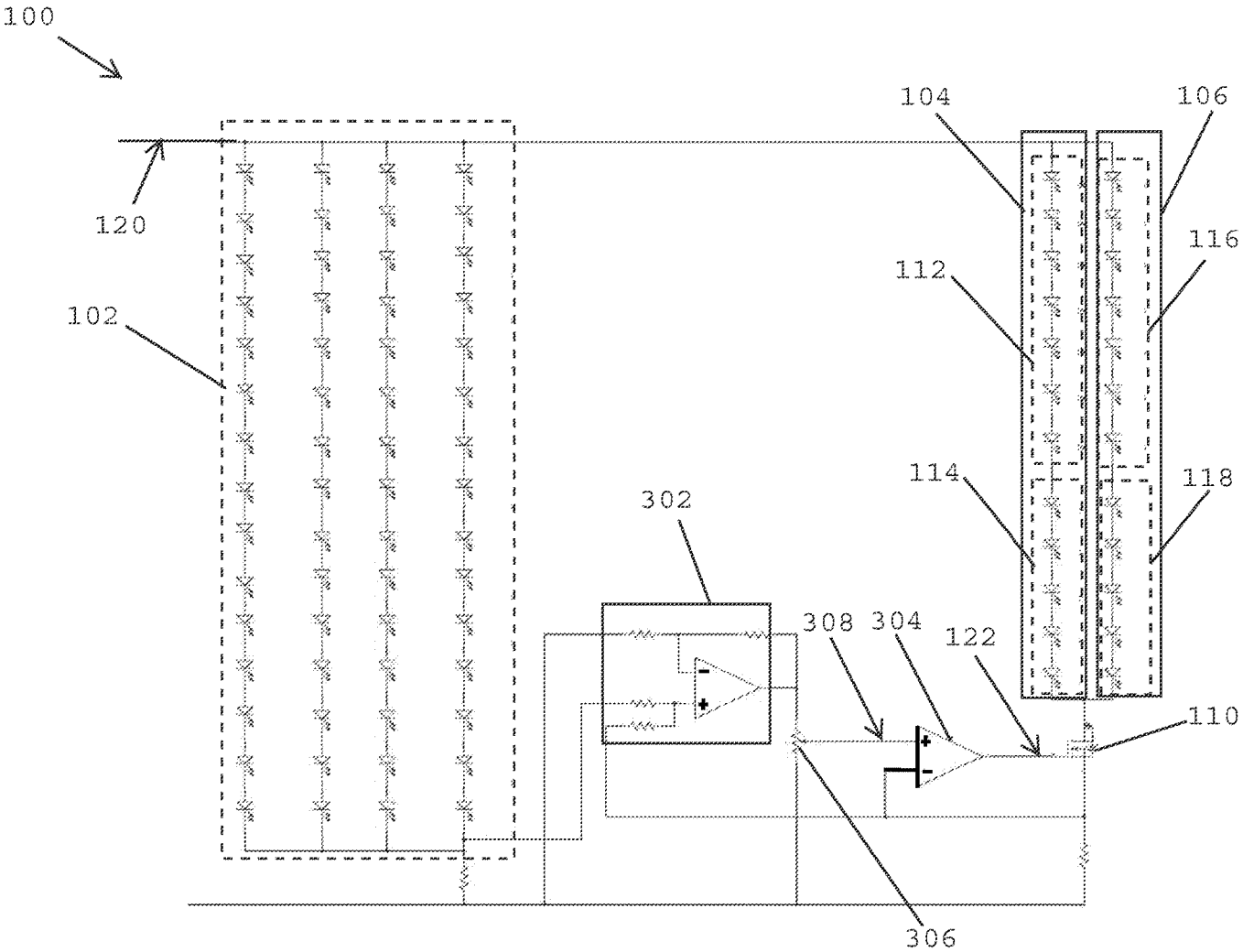
FIG. 3 illustrates the lighting device of FIG. 1 including a schematic of the tuning circuit according to an example embodiment.

In some example embodiments, the white light tuning circuit 108 controls an amount of current that flows through the strings of blue and green light LEDs 104, 106 by controlling the transistor 110. The tuning circuit 108 may be an analog tuning circuit that includes analog circuit components as illustrated in FIG. 3. By changing current flow through the strings of blue and green light LEDs 104, 106, the tuning circuit 108 controls the distribution of current between two groups of LEDs, i.e., the strings of white light LEDs 102 as one group and the strings of blue and green light LEDs 104, 106 as another group. The CCT of the combined light that is the combination of the warm white light emitted by the string of white light LEDs 102 and the blue light and green light emitted by the strings of blue and green LEDs 104, 106 may be tuned by changing the distribution of current among the string of white light LEDs 102 and the strings of blue and green LEDs 104, 106.

The required forward voltage for each string of blue and green LEDs 104, 106 to emit the blue and green lights is intentionally lower than the required forward voltage for the strings of the white light LEDs 102 to emit the warm white light. The difference in the forward voltages may be large enough to force all the current provided, for example, by an LED driver on a connection 120 (e.g., an electrical wire or a wire trace) to flow through the strings of blue and green LEDs 104, 106, when the transistor 110 is on and in full conduction. The transistor 110 is controlled by the tuning circuit 108 using an analog tuning signal provided to the gate terminal of the transistor 110 via a connection 122 (e.g., an electrical wire or a wire trace). As the voltage of the tuning signal provided to the gate terminal of the transistor (MOSFET) 110 via the connection 122 is reduced, the Source-Drain resistance of the transistor 110 increases from very low or near short circuit resistance, to very high or near open circuit resistance.

Figure 5:
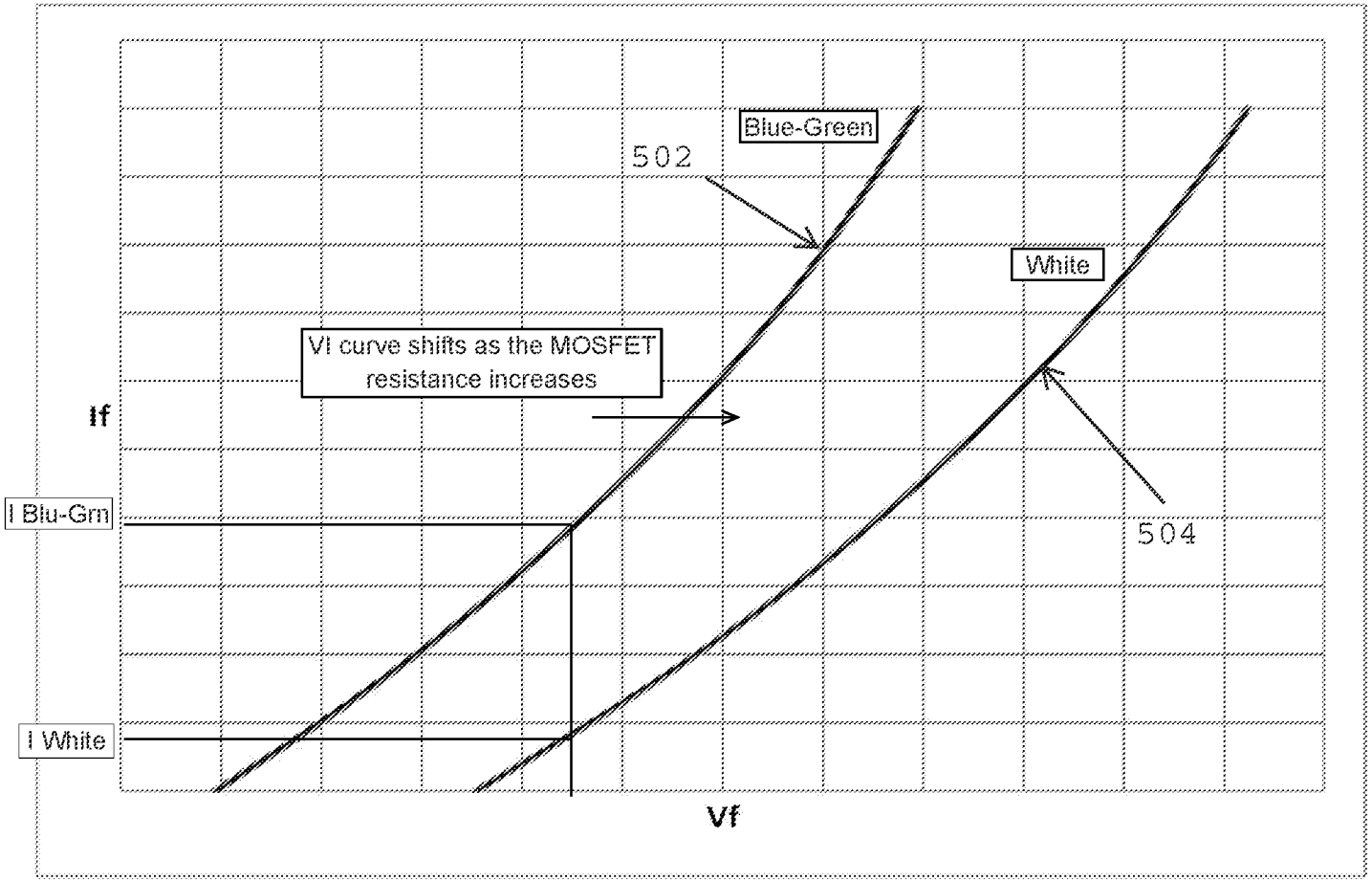
FIG. 5 illustrates voltage-current (VI) curves for warm white LEDs and blue and green LEDs according to an example embodiment.

As the source-drain resistance increases in response to decrease in the tuning signal from the tuning circuit 108, the current on the connection 120 starts diverting from the strings of blue and green LEDs 104, 106 to the strings of the white light LEDs 102. When the tuning signal on the connection 122 is decreased such that the transistor is turned OFF and the source-drain resistance is near an open circuit resistance, the current on the connection 120 flows only through the strings of the white light LEDs 102. FIG. 5 illustrates V-I characteristic curves of the white light LEDs 102 and the strings of blue and green LEDs 104, 106 that demonstrate such behavior in response to the change in the source-drain resistance of the transistor 110.

In some example embodiments, the amount of flux of the warm white light emitted by the strings of white light LEDs 102 depends on the amount of current flowing through the strings of white light LEDs 102, and the amount of flux of the blue light and the green light emitted by the strings of blue and green light LEDs 104, 106 depends on the amount of current flowing through the strings of blue and green light LEDs 104, 106. When the transistor 110 is turned off, the combined light from the lighting device 100 has the warm CCT of the white light emitted by the strings of white light LEDs 102. By turning off the transistor (e.g., by providing a voltage level to the gate terminal of the transistor 108 that results in a very high resistance through the transistor 108), the tuning circuit 108 can steer essentially all of the current provided on the connection 120 to the strings of white LEDs 102. For example, the transistor 110 may be a MOSFET that is controlled by the tuning circuit 108 to operate in the active region or in linear mode. To illustrate, the transistor 110 may be an N-channel MOSFET such as STN2NF10.

To tune the combined light from the warm CCT toward a cooler CCT, the amount of current that flows through the strings of blue and green light LEDs 104, 106 can be increased and the amount of current that flows through the strings of white light LEDs 102 can be decreased without changing the amount of current provided via the connection 120. To illustrate, the tuning circuit 108 can reduce the resistance of the transistor 110 by changing the tuning signal (e.g., changing the voltage level) provided to the gate of the transistor 110 via the connection 122, which steers more of the current provided at the connection 120 to the strings of blue and green light LEDs 104, 106 and away from the strings of white light LEDs 102. Increasing the current through the strings of blue and green light LEDs 104, 106 by a particular tuning amount reduces the amount of current through the strings of white LEDs 102 by the same tuning amount. For example, the current provided at the connection 120 may be provided by a constant current source, such as an LED driver, that may be adjustable based on a dim setting.

Increasing the amount of current that flows through the strings of blue and green light LEDs 104, 106, which reduces the amount of current that flows through the strings of white LEDs 102, increases the CCT of the combined light along the white light tuning path away from the warm CCT of the white light emitted by the strings of white LEDs 102 toward a cool CCT. Decreasing the amount of current that flows through the strings of blue and green light LEDs 104, 106, which increases the amount of current that flows through the strings of white LEDs 102, decreases the CCT of the combined light along the white light tuning path toward the warm CCT of the white light emitted by the strings of white LEDs 102.

In some example embodiments, the tuning circuit 108 steers the current between the strings of white LEDs 102 and the strings of blue and green light LEDs 104, 106 based on a CCT selection, for example, via a tuner input. For example, the selection of a particular CCT of the combined light emitted by the strings of white LEDs 102 and the strings of blue and green light LEDs 104, 106 (i.e., the combined light emitted by lighting device 100) may be set during the manufacturing of the lighting device 100, during installation, and/or post installation. For example, the lighting device 100 may be tuned to have a CCT of 3200K for some applications and a CCT of 3500K for other applications by accordingly steering the current on the connection 120 between the strings of white LEDs 102 and the strings of blue and green light LEDs 104, 106.

In some example embodiments, for a particular CCT selection, the tuning circuit 108 may maintain current distribution between the strings of white LEDs 102 and the strings of blue and green light LEDs 104, 106 at the same percentage of the total current for different amounts of the total current provided via the connection 120. For example, when the total current changes due to dimming, the tuning circuit 108 can maintain the current distribution between the strings of white LEDs 102 and the strings of blue and green light LEDs 104, 106 unchanged. Maintaining the same current distribution between the strings of white LEDs 102 and the strings of blue and green light LEDs 104 results in maintaining the CCT of the combined light essentially the same as the CCT of the combined light prior to the change in the total current due to the dimming.

The lighting device 100 enables white light tuning using just two current channels, i.e., the strings of white LEDs 102 and the strings of blue and green light LEDs 104, 106. By controlling the current distribution among the two current channels the lighting device 100 may be tuned to emit a light that has a desired CCT. Limiting the number of current channels to only two channels reduces design complexity and cost compared to systems and devices that require more current channels. Compared to a typical white light tuning approach that uses a string of warm white light LEDs and another string of cool white light LEDs, the lighting device 100 provides a white light tuning path 208 that is closer to the black-body curve.

In some alternative embodiments, the lighting device 100 may include a single string of white light LEDs instead of the multiple strings of white light LEDs 102 without departing from the scope of this disclosure. In some alternative embodiments, the lighting device 100 may include fewer or more than the two strings of blue and green light LEDs 104, 106 and fewer or more green light LEDs and blue light LEDs without departing from the scope of this disclosure.

Figure 2:
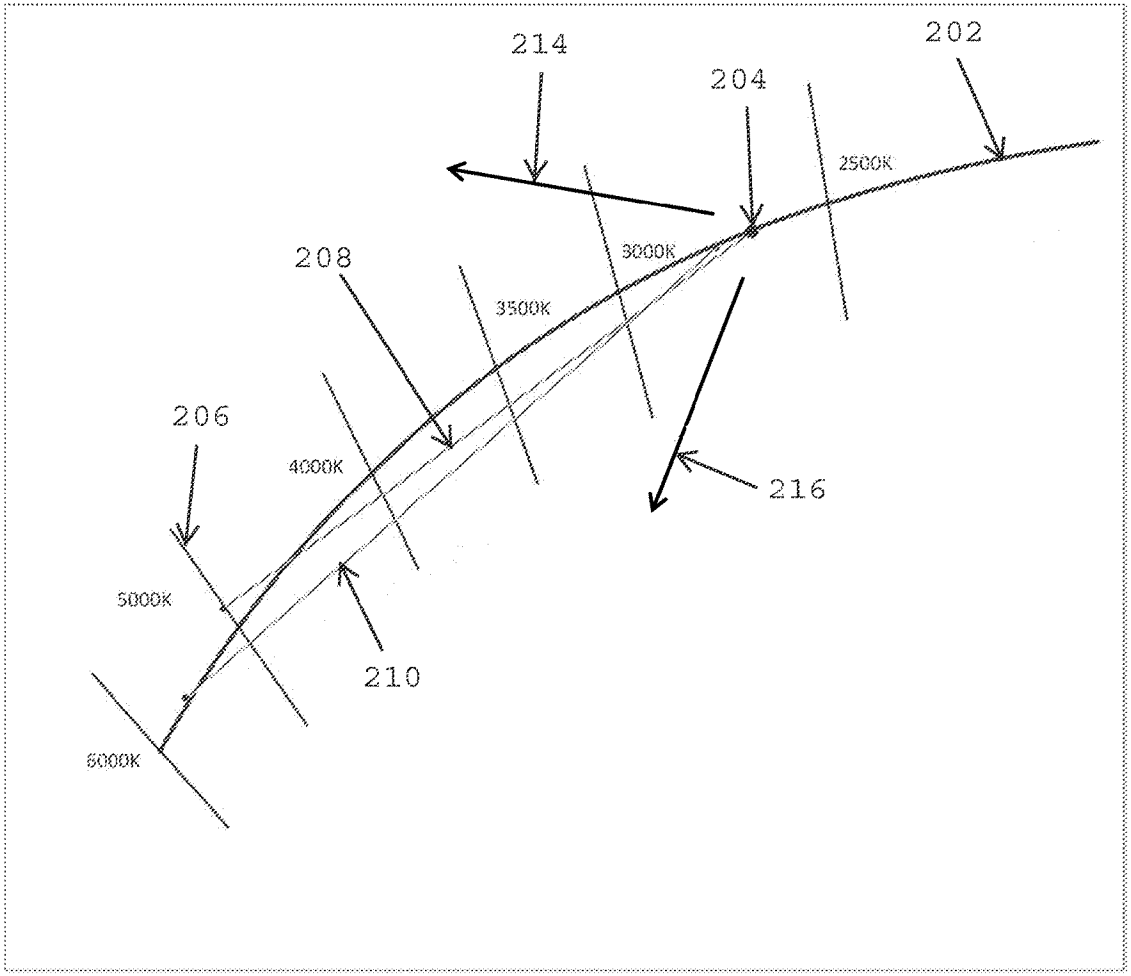
FIG. 2 illustrates a white light tuning path curve relative to a black-body radiation curve according to an example embodiment.

FIG. 2 illustrates a white light tuning path curve 208 relative to a black-body curve 202 according to an example embodiment. Referring to FIGS. 1 and 2, the white light tuning path curve 208 shown in FIG. 2 corresponds to a CCT tuning path for a combined light that is a combination of a warm white light and blue and green lights. To illustrate, the combined light may be based on a warm white light emitted by, for example, the strings of white light LEDS 102 and blue light and green light emitted by, for example, the strings of blue and green light LEDs 104, 106 of FIG. 1. For example, the white light tuning path curve 208 may include CCT values between a warm CCT 204 (e.g., approximately 2700K) and a cool CCT 206 (e.g., approximately 5000K).

The flux ratio of the green light emitted by the groups of green light LEDs 112, 116 to the blue light emitted by the groups of blue light LEDs 114, 118 may be selected to achieve the white light tuning path curve 208. The strings of blue and green light LEDs 104, 106 may be selected to produce green light and the blue light that have a combined flux to achieve the cool CCT 206 of the combined light. To illustrate, the warm CCT 204 may correspond to only the white light emitted by the strings of white LEDS 102 without contribution from the blue light and the green light. The cool CCT 206 may be a result of the blue light and the green light contributing larger flux amounts to the combined light as compared to the flux contribution of the warm white light emitted by the strings of white light LEDS 102. That is, for a particular amount of current provided on the connection 120, the flux contribution of the warm white light emitted by the strings of white light LEDS 102 is lower at the cool CCT 206 compared to the flux contribution of the warm white light emitted by the strings of white light LEDS 102 at the warm CCT 204. In some example embodiments, the flux contribution of the warm white light may be negligible or zero at the cool CCT 206.

In FIG. 2, the arrow 214 illustrates the effect of the green light on the combined light relative to the black-body radiation curve 202, and the arrow 216 illustrates the effect of blue light on the combined light relative to the black-body radiation curve 202. The combined contribution of the green light and the blue light to the combined light results in the white light tuning path curve 208. The white light tuning path curve 208 may be directed from the CCT 204 in a direction that is between the arrows 214 and 216 based on the ratio of the corresponding luminous flux. As illustrated in FIG. 2, a significant portion of the white light tuning path curve 208 is closer to the black-body radiation curve 202 than a white light tuning path curve 210, which is based on a combination of a warm white light and a cool white light.

In contrast to a white light tuning method that is based on, for example, amber, green, and red lights, use of blue light and green light with a fixed ratio of corresponding fluxes results in a white light tuning path that is often preferably close to the black-body radiation curve 202. Further, unlike a typical white light tuning approach that uses a string of warm white LEDs and another string of cool light LEDs, where the CCT of the resulting light lies on the white light tuning path curve 210 between the CCT of the warm white light and the CCT of the cool white light on the black body curve 202, the lighting device 100 provides that the white light tuning path 208 that is closer to the black-body curve 202. To illustrate, the lighting device 100 may be set, for example, during manufacturing or installation, to emit a light that has a particular CCT that is on the preferable white light tuning path curve 208 instead of the white light tuning path curve 210.

In some example embodiments, a clamping circuit or component can be introduced in the tuning circuit 108 to keep the white light tuning path curve 208 closer to the black body curve 202 by forcing a slope change at a predetermined point in the chromaticity chart or color space. For example, if the group of green LEDs 112 is clamped to a fixed current near a CCT of 4000K of the combined light, then the white light tuning path curve 208 will instead follow the direction of the arrow 216 when the CCT of the combined light reaches 4000K, resulting in the CCT of the combined light being more aligned with the black body curve 202.

FIG. 3 illustrates the lighting device of FIG. 1 including a schematic of the tuning circuit 108 of FIG. 1 according to an example embodiment. Referring to FIGS. 1 and 3, in some example embodiments, the lighting device 100 includes a non-inverting summing amplifier 302, an error amplifier 304, and a potentiometer 306. For example, the tuning circuit 108 of FIG. 1 may include the summing amplifier 302, the error amplifier 304, and the potentiometer 306.

The summing amplifier 302 generates an output signal based on the sum of the current through the string of white LEDs 102 and the current through the strings of blue and green LEDs 104, 106. A reference signal that depends on the setting of the potentiometer 306 and the output signal from the summing amplifier 302 is provided to the error amplifier 304 on a connection 308 (e.g., an electrical wire). The error amplifier 304 provides the analog tuning signal to the transistor 110 via the connection 122 to control the amount of current through the strings of blue and green LEDs 104, 106 and the transistor 110. For example, the amount of current through the strings of blue and green LEDs 104, 106 and the transistor 110 may be maintain or adjusted by a tuning amount based on the tuning signal that is dependent on the setting of the potentiometer 306.

For example, when a constant current source provides the current on the connection 120, increasing/decreasing the amount of current through the strings of blue and green LEDs 104, 106 by a tuning amount decreases/increases the amount of current through the string of white LEDs 102 by the same tuning amount. As described above, the CCT of the combined light, which is the combination of the warm white light emitted by the string of white LEDs 102 and the blue light and green light emitted by the strings of blue and green LEDs 104, 106, may be tuned by changing the distribution of current among the string of white LEDs 102 and the strings of blue and green LEDs 104, 106.

By deriving the reference signal provided to the error amplifier 304 via the connection 308 from the total input current on the connection 120, which equals the sum of the current through the strings of white light LEDs 102 as well as the current through the strings of blue and green LEDs 104, 106, the tuning circuit 108 may maintain the allocation of current between the string of white LEDs 102 and the strings of blue and green LEDs 104, 106 at essentially the same percentage of the total current even when the amount of the total current changes. For example, the amount of current on the connection 120 may change due to dimming by a user. By maintaining the relative allocation of current, the relative flux contribution of the lights from the string of white LEDs 102 and the strings of blue and green LEDs 104, 106 may be unaffected by a change in the total current.

To illustrate, the reference signal on the connection 308 from the summing amplifier 302 represents the currents in each of the strings of white light LEDs 102 and the strings of blue and green LEDs 104, 106. Because the amount of the current through the strings of blue and green LEDs 104, 106 and the transistor 110 that the tuning circuit 108 controls is proportional to the amount of the current on the connection 120, a variation in the amount of the current on the connection 120 affects the amount of current through the strings of blue and green LEDs 104, 106 and the transistor 110, thereby maintaining the same proportion. As a result, if a user tunes the lighting device 100 to emit a light that has a particular CCT (e.g., 3500 k), then the particular CCT is essentially maintained throughout the full dimming range of the lighting device 100. For example, a particular CCT of the combined light may be maintained from 100% to a minimum dimming level as low as 0.1%.

Figure 6:
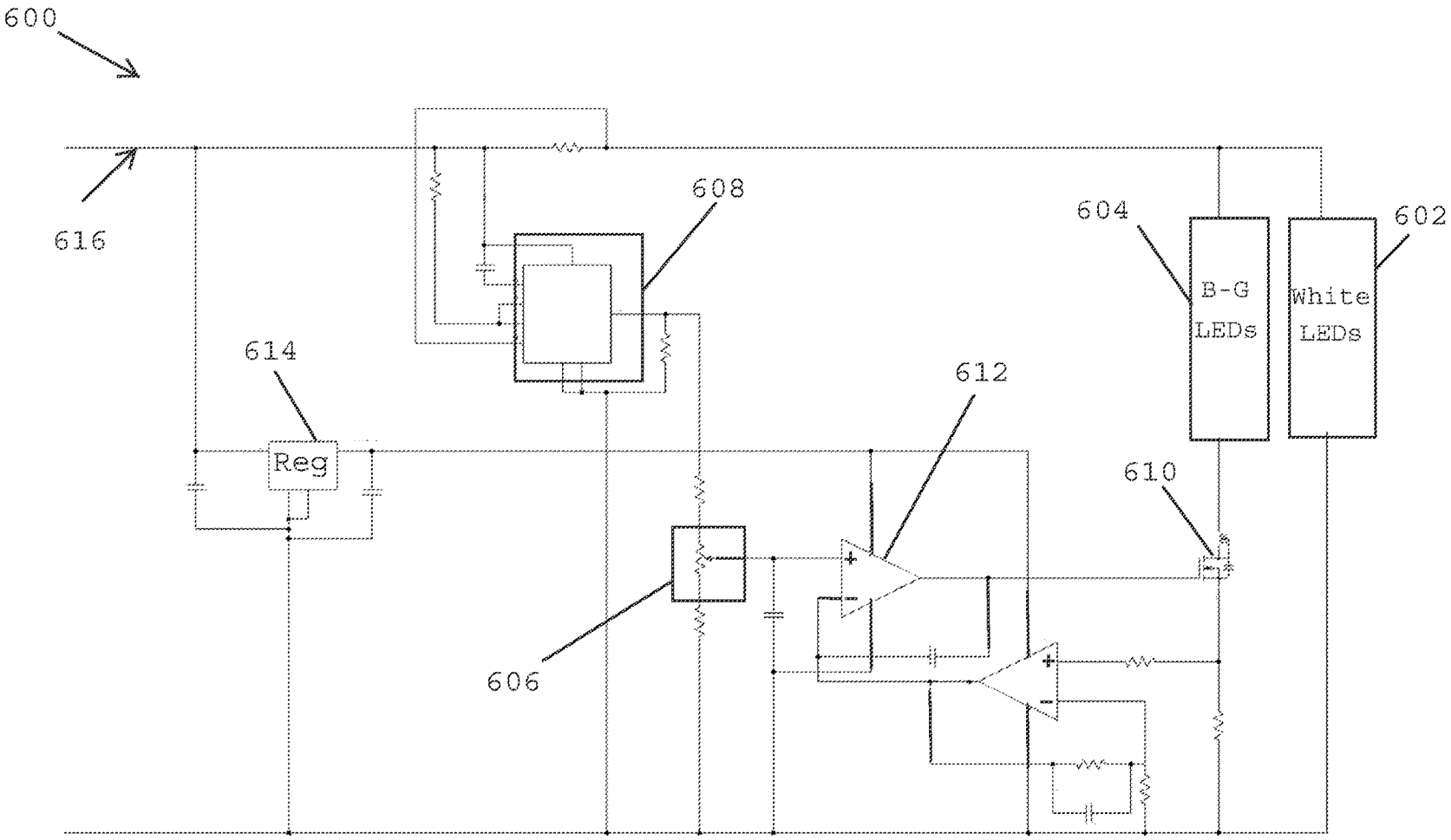
FIG. 6 illustrates a lighting device including a white light tuning circuit that is based on a current sensing amplifier according to an example embodiment.

In some alternative embodiments, the input signals to the error amplifier 304 and the summing amplifier 302 can be pre-amplified to reduce noise, increase accuracy and allow the use of a lower value sense resistor, by using a precision low noise zero drift operational amplifier, such as LTC2057. The summing amplifier 302 can also be replaced by a high side precision current sense amplifier, such as LTC6102, that is connected to the connection 120 as shown in FIG. 6.

As described above, the transistor 110 is in series with the strings of blue and green LEDs 104, 106 that have a lower nominal forward voltage than the strings of white light LEDs 102. The transistor 110 is biased by the tuning signal from the error amplifier 304 such that the resistance of the transistor 110 can be changed in a controlled manner, resulting in a change in the voltage across the strings of blue and green LEDs 104, 106. Since the strings of blue and green LEDs 104, 106 and the transistor 110 are in parallel with the string of white light LEDs 102, an increase in the resistance of the transistor 110 shifts the V-I relationship of the all strings of LEDs 102, 104, 106, from the V-I curve of the strings of blue and green LEDs 104, 106 to the V-I curve of the string of white light LEDs 102, resulting in lower current through the strings of blue and green LEDs 104, 106. As described above, the current through the transistor 110 and the strings of blue and green LEDs 104, 106 is fed back to the summing amplifier 302 for generating a reference signal that is provided to the error amplifier 304.

In some example embodiments, the potentiometer 306 may provide a CCT selection/adjustment input interface (e.g., the resistance adjustment input of the potentiometer) for selecting a target CCT of the combined light for performing the white light tuning of the combined light by changing the CCT of the combined light to match the target CCT. To illustrate, the potentiometer 306 may be used to set or change the amount of current that flows through the strings of blue and green LEDs 104, 106, and thus changing the amount of current that flows through the white light LEDs 102. For example, because the resistance of the transistor 110 depends on the setting of potentiometer 306, the proportion of the current on the connection 120 that flows through the string of white light LEDs 102 and the proportion of the current on the connection 120 that flows through the strings of blue and green LEDs 104, 106 depend the setting of the potentiometer 306. For a particular amount of the current provided on the connection 120, changing the current proportions changes the fluxes of the blue light and the green light emitted by the strings of blue and green LEDs 104, 106 as well as the flux of the warm white light emitted by the string of white light LEDs 102.

In some example embodiments, the potentiometer 306 may be a rotary switch that selects from a set of fixed value resistances of the potentiometer 306 for preset CCT values. Alternatively, another component such as a traditional 0-10 volt dimmer control may be used to as the potentiometer 306 to provide a CCT selection/adjustment input interface to adjust the current through the strings of blue and green LEDs 104, 106.

By adjusting the setting of the potentiometer 306 to change the flux contributions of the warm white light and the blue and green lights to the flux of the combined light, a desired CCT of the combined light on a desired white light tuning path curve may be achieved. Using the analog closed loop feedback control described above with respect to FIGS. 1 and 3 enables white light tuning that is accurate, stable, and low cost.

In some alternative embodiments, the lighting device 100 may include one or more strings of white light LEDs ("correcting LEDs") instead of the strings of blue and green light LEDs 104, 106 in parallel with the string of white light LEDs 102. For example, the correcting LEDs may be used to perform fine CCT tuning of the white light emitted by the string of white LEDs 102. For example, the string of white light LEDs 102 may emit a white light intended to have a particular CCT and the additional string(s) of correcting LEDs may be used to fine tune the CCT of the white light from the LEDs 102 such that the combined light has a slightly different CCT than the CCT of the light emitted by the string of white light LEDs 102. The voltage/current of the string(s) of correcting LEDs may be adjusted in a similar manner as described above with respect to the strings of blue and green LEDs 104, 106. The ability to fine tune of the light emitted by the string of white LEDs 102 can reduce the need for tight binning of white light LEDs from which the LEDs 102 are selected.

Although particular circuit components are shown in FIG. 3, in alternative embodiments, the lighting device 100 may include alternative or additional components that may be used to implement the white light tuning described above without departing from the scope of this disclosure. In some alternative embodiments, some of the components shown in FIG. 3 may be integrated into a single component without departing from the scope of this disclosure.

Figure 4:
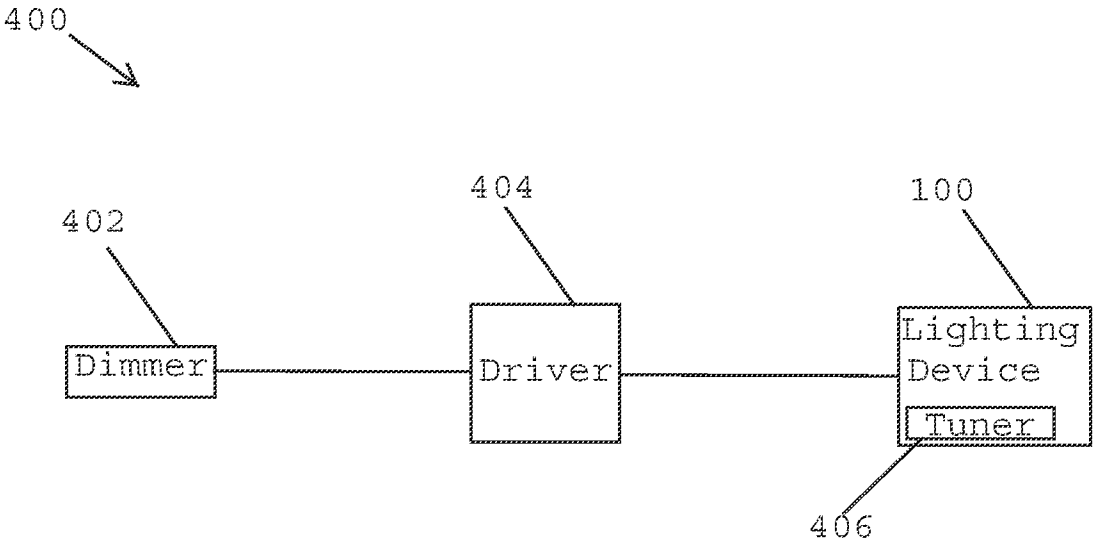
FIG. 4 illustrates a lighting system including the lighting device of FIG. 1 according to an example embodiment.

FIG. 4 illustrates a lighting system 400 including the lighting device of FIG. 1 according to an example embodiment. Referring to FIGS. 1-4, in some example embodiments, the lighting system 400 includes a dimmer 402, a driver 404 coupled to the dimmer 402, and the lighting device 100 coupled to the driver 404. The dimmer 402 may control the amount of current provided to the lighting device 100 by the driver 404. For example, the driver 404 may be an LED driver that provides power to the lighting device 100 including the string of white light LEDs 102 and the strings of blue and green LEDs 104, 106. The dimmer 402 may be a wall mounted dimmer or another type of dimmer as can be understood by those of ordinary skill in the art with the benefit of this disclosure. The amount of current provided to the lighting device 100 by the driver 404 may be increased or decreased by changing the setting of the dimmer 402.

In some example embodiments, the driver 404 may be a constant current source that provides a constant current to the lighting device 100 for a particular dimmer setting of the dimmer 402. The CCT of the light from the lighting device 100, i.e., the combined light that is the combination of the warm white light emitted by the string of white LEDs 102 and the blue light and green light emitted by the strings of blue and green LEDs 104, 106, may be tuned as described above based on a setting of a tuner 406. For example, the tuner 406 may correspond to the potentiometer 306 or an equivalent component and may be set/adjusted during manufacturing of the lighting device 100, during installation, and/or after installation.

In some example embodiments, the driver 404 and the lighting device 100 may be in a single lighting fixture. Alternatively, the lighting device 100 may be a light fixture that is powered by the driver 404 that is not included in the lighting fixture. In some alternative embodiments, the dimmer 402, the driver 404, and the lighting device 100 may be included in a lighting fixture without departing from the scope of this disclosure.

FIG. 5 illustrates voltage-current (VI) curves for warm white light LEDs and blue and green LEDs according to an example embodiment. In FIG. 5, the current amounts are shown on the vertical axis and the voltage levels are shown on the horizontal axis. Referring to FIGS. 1-5, in some example embodiments, the V-I curve 502 corresponds to the voltage-to-current relationship for the strings of blue and green LEDs 104, 106, and the V-I curve 504 corresponds to the voltage-to-current relationship for the string of white light LEDs 102. As the resistance of the transistor 110 increases in response to a decrease in the voltage level of the tuning signal provided to the gate terminal of the transistor 110, the current amount through the strings of blue and green LEDs 104, 106 decrease, and the current amount through the string of white light LEDs 102 increases.

For a particular amount of the current from the driver 404, as the current through the strings of blue and green LEDs 104, 106 is decreased because of current steering by the tuning circuit 108, the overall voltage and current relationship for both the string of white light LEDs 102 and the strings of blue and green LEDs 104, 106 shifts toward the V-I curve 504. On the other hand, as the current through the strings of blue and green LEDs 104, 106 increases because of current steering, the overall voltage and current relationship for both the string of white light LEDs 102 and the strings of blue and green LEDs 104, 106 shifts toward the V-I curve 502.

FIG. 6 illustrates a lighting device 600 including a white light tuning circuit that is based on a precision high-side current sensing amplifier 608 according to an example embodiment. In some example embodiments, the lighting device 600 includes white light LEDs 602 and blue and green LEDs 604. For example, the white light LEDs 602 may correspond to the string of white light LEDs 102 of FIGS. 1 and 3, and the blue and green LEDs 604 may correspond to the strings of blue and green LEDs 104, 106. The lighting device 600 also includes a potentiometer 606, the high side precision current sense amplifier 608, and the error amplifier 612. The error amplifier 612 provides an analog tuning signal to a gate terminal of a transistor 610 that is in series with the blue and green LEDs 604. For example, the transistor 610 may correspond to the transistor 110 of FIGS. 1 and 3, and the resistance of the transistor 610 may be controlled based on the tuning signal in the same manner as described above with respect to the transistor 110. The potentiometer 606, the high side precision current sense amplifier 608, and the error amplifier 612 along with other supporting components shown in FIG. 6 may operate as a white light tuning circuit to tune the white light provided by the lighting device 600 to have a desired CCT.

As illustrated in FIG. 6, in some example embodiments, the high side precision current sense amplifier 608 (e.g., part no. LTC6102) may be used instead of the summing amplifier 302 shown in FIG. 3. The high side precision current sense amplifier 608 operates based on the current on a connection 616 (e.g., an electrical wire) before the current is split among the LEDs 602 and LEDs 604. The current on the connection 616 is proportioned among the white light LEDs 602 and the blue and green LEDs 604 based on the setting of the potentiometer 606 in a similar manner as described with respect to the potentiometer 306.

In some example embodiments, a voltage regulator 614 may be used to provide appropriate voltage level to some of the components of the lighting device 600. For example, the regulator 614 may be connected to the connection 616 and use the voltage at the connection 616 as input to generate a voltage level compatible with components such as the error amplifier 612.

In general, the lighting device 600 offers the white light tuning advantages described with respect to the lighting device 100. Similar to the lighting device 100, the lighting device 600 enables stable, accurate and cost effective white light tuning by using fewer strings of different color LEDs that other white tuning methods that use at least three different color LEDs and without the need to duplicate the same number of white light LEDs.

In some example embodiments, some of the components of the lighting device 600 may be integrated into a single component without departing from the scope of this disclosure. In some alternative embodiments, alternative or additional components than those shown in FIG. 6 may be used in the lighting device 100 without departing from the scope of this disclosure. In some example embodiments, the lighting device 600 may be used in the system 400 of FIG. 4 instead of the lighting device 100 without departing from the scope of this disclosure.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a first string of light emitting diodes (LEDs) to emit a white light having a warm white Correlated Color Temperature (CCT);

a second string of LEDs comprising:

blue light LEDs that emit a blue light; and green light LEDs that emit a green light; and a tuning circuit to adjust an amount of current flowing through the second string of LEDs, wherein the white light, the blue light and the green light produce a combined light and wherein a CCT of the combined light is tuned by adjusting the amount of current flowing through the second string of LEDs.

2. The lighting device of claim 1, further comprising a transistor coupled in series with the second string of LEDs, wherein the tuning circuit provides an analog signal to the transistor to adjust the amount of current flowing through the second string of LEDs.

3. The lighting device of claim 1, wherein a ratio of a flux of the blue light to a flux of the green light is set based on a white light tuning path between the warm white CCT and a desired cool white CCT.

4. The lighting device of claim 3, wherein the CCT of the combined light is the warm white CCT when a flow of current through the second string of LEDs is turned off by the tuning circuit.

5. The lighting device of claim 1, wherein increasing the amount of current that flows through the second string of LEDs by a tuning amount decreases an amount of current that flows through the first string of LEDs by the tuning amount.

6. The lighting device of claim 1, wherein the CCT of the combined light is adjustable to a cool white CCT by increasing the amount of current flowing through the second string of LEDs.

7. The lighting device of claim 1, further comprising a CCT selection input interface, wherein the tuning circuit adjusts a distribution of an input current among the first string of LEDs and the second string of LEDs at least based on an input provided via the CCT selection input interface.

8. The lighting device of claim 1, wherein the tuning circuit comprises a summing circuit to add an amount of current flowing through the first string of LEDs and the amount of current flowing through the second string of LEDs and wherein the tuning circuit adjusts the amount of current flowing through the second string of LEDs further based on a sum of the amount of current flowing through the first string of LEDs and the amount of current flowing through the second string of LEDs.

9. The lighting device of claim 1, wherein the tuning circuit comprises a high side current sense amplifier and wherein the tuning circuit adjusts the amount of current flowing through the second string of LEDs further based on an output of the high side current sense amplifier that depends on an amount of current provided to the first string of LEDs and the second string of LEDs.

10. The lighting device of claim 1, wherein a required forward voltage across the second string of LEDs to emit the blue light and the green light is less than a required forward voltage across the first string of LEDs to emit the white light.

11. A lighting system, comprising:

a lighting device; and a driver that provides power to the lighting device, wherein the lighting device comprises:

a first string of light emitting diodes (LEDs) to emit a white light having a warm white Correlated Color Temperature (CCT);

a second string of LEDs comprising:

blue light LEDs that emit a blue light; and green light LEDs that emit a green light; and a tuning circuit to adjust an amount of current flowing through the second string of LEDs, wherein the white light, the blue light and the green light produce a combined light and wherein a CCT of the combined light is tuned by adjusting the amount of current flowing through the second string of LEDs.

12. The lighting system of claim 11, further comprising a transistor coupled in series with the second string of LEDs, wherein the tuning circuit provides an analog signal to the transistor to adjust the amount of current flowing through the second string of LEDs.

13. The lighting system of claim 12, further comprising a dimmer that controls an amount of the current that the driver provides to the first string of LEDs and the second string of LEDs.

14. The lighting system of claim 11, further comprising a CCT selection input interface, wherein the tuning circuit adjusts a distribution of an input current among the first string of LEDs and the second string of LEDs at least based on an input provided via the CCT selection input interface.

15. The lighting system of claim 11, wherein the tuning circuit comprises a summing circuit to add an amount of current flowing through the first string of LEDs and the amount of current flowing through the second string of LEDs and wherein the tuning circuit adjusts the amount of current flowing through the second string of LEDs further based on a sum of the amount of current flowing through the first string of LEDs and the amount of current flowing through the second string of LEDs.

16. The lighting system of claim 11, wherein the tuning circuit comprises a high side current sense amplifier and wherein the tuning circuit adjusts the amount of current flowing through the second string of LEDs further based on an output of the high side current sense amplifier that depends on an amount of current provided to the first string of LEDs and the second string of LEDs.

17. A method of tuning a combined light emitted by a light source, the method comprising:

providing a first string of LEDs comprising white light LEDs that emit a white light having a warm white Correlated Color Temperature (CCT);

providing a second string of LEDs comprising blue light LEDs and green light LEDs, wherein the blue light LEDs emit a blue light, wherein the green light LEDs emit a green light, wherein a required forward voltage across the second string of LEDs to emit the blue light and the green light is less than a required forward voltage across the first string of LEDs to emit the white light; and controlling, by a tuning circuit, an amount of current flowing through the second string of LEDs by adjusting an analog signal provided to a transistor that is in series with the second string of LEDs, wherein the white light, the blue light and the green light produce the combined light and wherein a CCT of the combined light is tuned by adjusting the amount of current flowing through the second string of LEDs.

18. The method of claim 17, further comprising setting a ratio of a flux of the blue light to a flux of the green light such that the CCT of the combined light is adjustable to have a CCT value that is on a white light tuning path between the warm white CCT and a desired cool white CCT.

19. The method of claim 18, wherein setting the ratio of the flux of the blue light to the flux of the green light comprises selecting a number of the blue light LEDs that produce the flux of the blue light when a particular amount of current flows through the blue light LEDs and selecting a number of the green light LEDs that produce the flux of the green light when the particular amount of current flows through the green light LEDs.

20. The method of claim 17, further comprising tuning the CCT of the combined light to have a target CCT that based on a user input selecting the target CCT.

* * * * *